US006447353B1

(12) United States Patent
Henry

(10) Patent No.: US 6,447,353 B1
(45) Date of Patent: Sep. 10, 2002

(54) TODDLER/ADULT FLOAT JACKET

(76) Inventor: Joseph E Henry, 5514 Golden Dr., Tampa, FL (US) 33634

( * ) Notice: Subject to any disclaimer, the term of this patent is extended or adjusted under 35 U.S.C. 154(b) by 0 days.

(21) Appl. No.: 09/840,216

(22) Filed: Apr. 23, 2001

(51) Int. Cl.[7] ..... B63C 9/08

(52) U.S. Cl. ..... 441/106; 441/88; 441/89; 441/117

(58) Field of Search ..... 441/87–89, 102–108, 441/117, 120, 123

(56) References Cited

U.S. PATENT DOCUMENTS

| | | | | | |
|---|---|---|---|---|---|
| 3,931,657 | A | | 1/1976 | Jones | |
| 4,047,255 | A | * | 9/1977 | Kiefer | 9/337 |
| 4,052,762 | A | | 10/1977 | Zawislak | |
| 4,097,947 | A | * | 7/1978 | Kiefer | 9/338 |
| 4,167,051 | A | | 9/1979 | Galecke | |
| 4,193,153 | A | | 3/1980 | Tyrer et al. | |
| 4,297,758 | A | | 11/1981 | Moran | |
| 4,308,629 | A | | 1/1982 | Freemon | |
| RE31,305 | E | | 7/1983 | Moran | |
| 4,668,201 | A | | 5/1987 | Stark | |
| 4,871,338 | A | * | 10/1989 | Hoffman | 441/116 |
| 4,934,973 | A | | 6/1990 | Taylor | |
| 5,374,192 | A | | 12/1994 | Marble et al. | |
| 5,409,411 | A | | 4/1995 | Schrieber | |
| 5,603,646 | A | * | 2/1997 | Tobias | 441/94 |
| D397,286 | S | * | 8/1998 | Dreyfus et al. | D8/358 |
| 5,855,497 | A | | 1/1999 | French | |
| 5,951,348 | A | | 9/1999 | Liong et al. | |
| 6,203,390 | B1 | * | 3/2001 | Elliott | 441/80 |

* cited by examiner

*Primary Examiner*—S. Joseph Morano
*Assistant Examiner*—Ajay Vasudera
(74) *Attorney, Agent, or Firm*—Michael E. Kroll

(57) ABSTRACT

A personal flotation vest device is provided that includes front flotation members that work in conjunction with a buoyant neck stabilizing member extending from the top of the back of the vest portion, and a buoyant buttocks support member extending from the bottom of the back of the vest portion, to provide a comfortable and stable platform for supporting the user in a substantially horizontal position. Adjustable fasteners allow a comfortable fit as the vest is donned. In addition, a whistle is attached to the vest by means of a lanyard for emergency use. A retraction device for retrieving and storing the extended lanyard is also provided. To avoid the onset of dehydration a pocket is provided for storing a fresh water container.

15 Claims, 7 Drawing Sheets

TODDLER/ADULT FLOAT JACKET

BACKGROUND OF THE INVENTION

1. Field of the Invention

Figure 1:
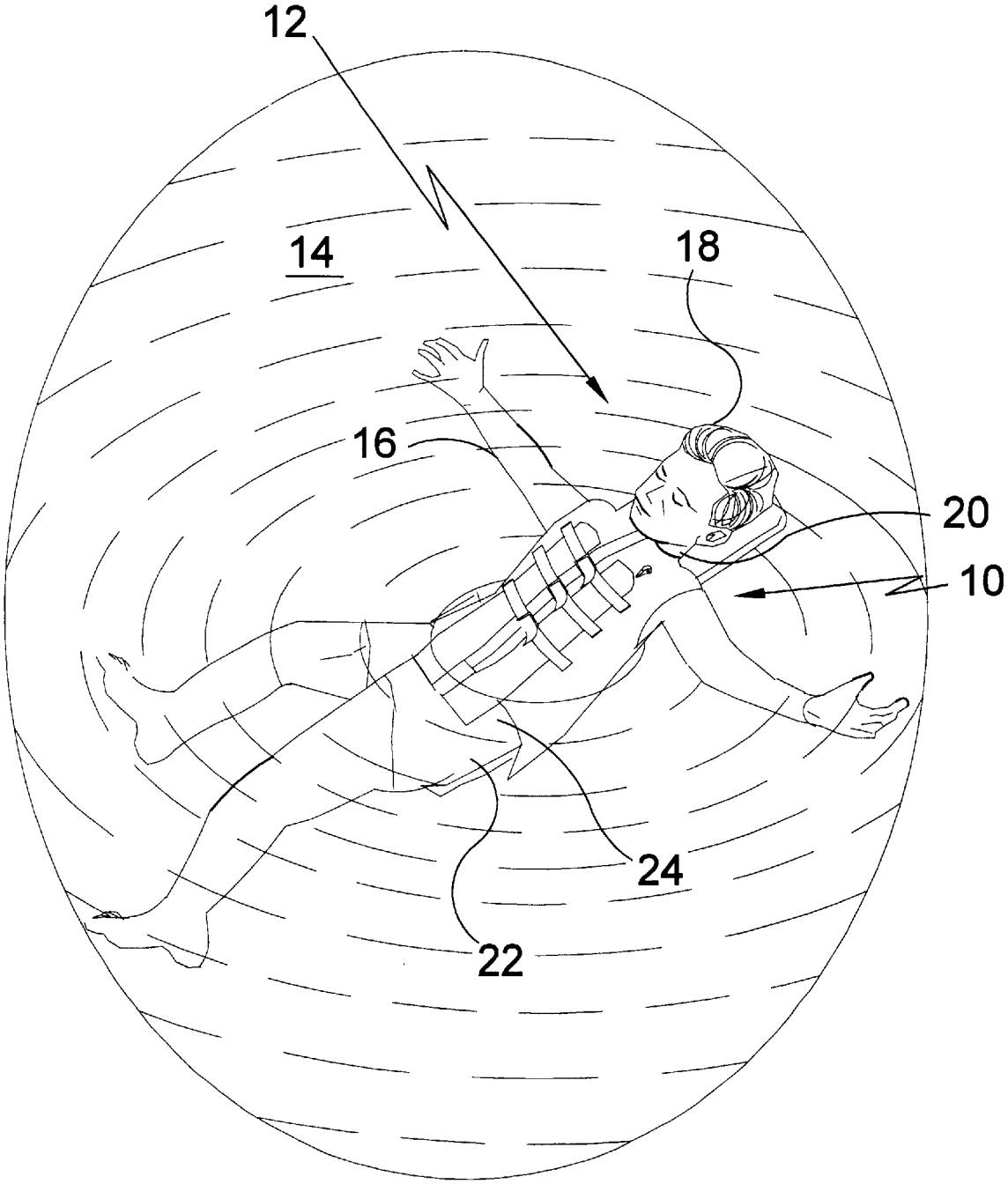

The present invention relates generally to flotation life vests.

2. Description of the Prior Art

There are other life vests device designed for water use. Typical of these is U.S. Pat. No. 3,931,657 issued to Jones on Jan. 13, 1976.

Another patent was issued to Zawislak on Oct. 11, 1977 as U.S. Pat. No. 4,052,762. Yet another U.S. Pat. No. 4,167,051 was issued to Galecke on Sep. 11, 1979 and still yet another was issued on Mar. 18, 1980 to Tyrer et al. as U.S. Pat. No. 4,193,153.

Another patent was issued to Moran on Nov. 3, 1981 as U.S. Pat. No. 4,297,758. Yet another U.S. Pat. No. Re. 31,305 was issued to Moran on Jul. 12, 1983. Another was issued to Freemon on Jan. 5, 1982 as U.S. Pat. No. 4,308,629 and still yet another was issued on May 26, 1987 to Stark as U.S. Pat. No. 4,668,201. Another was issued to Taylor on Jun. 19, 1990 as U.S. Pat. No. 4,934,973.

Another patent was issued to Marble et al. on Dec. 20, 1994 as U.S. Pat. No. 5,374,192. Yet another U.S. Pat. No. 5,409,411 was issued to Schrieber on Apr. 25, 1995. Another was issued to French on Jan. 5, 1999 as U.S. Pat. No. 5,855,497 and still yet another was issued on Sep. 14, 1999 to Liong et al. as U.S. Pat. No. 5,951,348.

A personal flotation device includes front and rear panels secured together to form an aesthetically appealing life vest. The panels are provided with relatively thin sheets of buoyant material of sufficient buoyancy to cause a user to remain afloat while in the water. The vest is provided with an inflatable bladder which may be readily inflated to increase the buoyancy of the flotation vest. The flotation vest is also provided with a collar through which the bladder extends and serves to cause the user to float face-up when the bladder is inflated.

A life preserver, shaped for use on a child or baby consisting of floatable plastic foam sections fitted together to form an enclosed vest with the bottom of the foam sections joined to a webbing formed with a pair of holes for the feet of the wearer and with a pair of straps fastened to the top front of the vest and the back section. The back section of the vest may be separated or joined together by snap fasteners and the upper sections of the vest are thicker than the lower sections of the vest to provide a greater degree of buoyancy to the head of the wearer so that he floats vertically like a buoy with head out of the water, when strapped in the device.

A buoyant life jacket which embodies a pair of front and side sections, each of which includes a series of articulated fabric-covered buoyant panels, and a rear section which is composed of a lightweight open-mesh fabric which is connected to the front and side sections at the rear of the latter. A slide fastener interconnects the two front and side sections at the center thereof and extends from the neck opening at the top to the bottom of the life jacket at the front thereof. Securing means in the form of a pair of flexible cloth fastening straps and buckles are arranged at the bottom of the rear and open-mesh fabric section for securing the buoyant life jacket in position of use on the body of the wearer.

A lifejacket is provided comprising a one piece body member of moulded, flexible, plastic foam. The lifejacket is divided into three distinct portions; that is a headrest portion, a shoulder portion and a chest portion, the shoulder portion incorporating a neck aperture. A longitudinal slit is provided which extends through the chest portion from the neck aperture thereby dividing the chest portion into two similar parts. The longitudinal slit facilitates the fitting of the life jacket to a wearer. A one piece tape is provided which passes through two longitudinally spaced transverse bores, one extending through the headrest portion and the other through the chest portion.

An inflatable life preserver of the encapsulated type encircling the neck of a wearer includes an inflatable cell or cells confined within a protective cover when in collapsed condition. The cover, formed of a strong fabric or other flexible material, comprises a pair of panels between which the cell is confined. The panels are permanently secured along the edge of a neck-encircling, center opening of the cover. The outer edges of the panels are separably connected, to confine the collapsed cells. Inflation of the cells causes separation of the panels. A protective flap is substantially coextensive in area and configuration with the panels, and lies between the panels so that the cover is in effect composed of three layers. The cells are confined between the flap and one of the panels, the flap being secured along its outer edge to said one panel while having its inner edge left free. In the event of accidental separation of the panels with the cells collapsed, the cells are not exposed, and are protected against damage by reason of being still confined between the flap and the panel to which it is connected. The flap and the panel to which it is connected thus form an auxiliary protective capsule or enclosure for the collapsed cells, which comes into use in the event of accidental opening of the primary enclosure constituted by the main cover panels.

An inflatable life preserver of the encapsulated type encircling the neck of a wearer includes an inflatable cell or cells confined within a protective cover when in collapsed condition. The cover, formed of a strong fabric or other flexible material, comprises a pair of panels between which the cell is confined. The panels are permanently secured along the edge of a neck-encircling, center opening of the cover. The outer edges of the panels are separably connected, to confine the collapsed cells. Inflation of the cells causes separation of the panels. A protective flap is substantially coextensive in area and configuration with the panels, and lies between the panels so that the cover is in effect composed of three layers. The cells are confined between the flap and one of the panels, the flap being secured along its outer edge to said one panel while having its inner edge left free. In the event of accidental separation of the panels with the cells collapsed, the cells are not exposed, and are protected against damage by reason of being still confined between the flap and the panel to which it is connected. The flap and the panel to which it is connected thus form an auxiliary protective capsule or enclosure for the collapsed cells, which comes into use in the event of accidental opening of the primary enclosure constituted by the main cover panels.

A harness device for supporting a person, such as a child or mentally or physically impaired person, in the water includes a wide chest band which is adjustable in length and lockable in any adjusted position. The device also includes a pair of shoulder straps secured to the upper end of the chest band on opposite sides thereof and which are adapted to extend over the person's shoulders. Each of the shoulder straps is adjustable in length and lockable in any adjusted position. The harness device also includes a pair of leg straps secured to the lower end of the chest band and adapted to extend around the person's legs at the crotch. Each of the leg straps is also adjustable in length and lockable in any adjusted position. The opposite ends of one of the leg straps is directly secured to one side of the chest band and the opposite ends of the other one of the leg straps is directly secured to the other side of the chest band. The device also includes a hand grip secured to the back of the chest band. The grip includes a strap directly secured at one end to a portion of the chest band adjacent the upper end thereof and secured at its other end to a portion of the chest band adjacent the lower end thereof. The device also includes a ring secured to the back of the chest band between it and the hand grip, a guide line secured at one end to the ring, and a handle secured to the other end of the guide line. The guide line is adjustable in length. With the hand grip and/or the guide line and handle, an adult, while remaining in a comfortable upright position, can easily support and be in control of the movements of the person, such as a child, in the water. A floatation device may be detachably secured to the chest band. In alternative embodiments, the lower edge of the chest band is secured to the upper edge of shorts, such as swimming shorts.

A substantially indestructible, long wearing, life preserver teddy bear toy is constructed with a shaped body of foam plastic enveloped in a tough, snug fitting, water repellent, close fitting fabric outer layer so that the body absorbs less than 5% of its total weight when immersed in water and has enough buoyancy to support a child.

A yoke-type life preserver is provided including a relatively thick buoyant filler assembly loosely received within a flexible outer cover panel assembly for the life preserver and with the buoyant filler assembly being constructed to enable the life preserver to be readily flexed in order to conform to the torso curvature of a person wearing the life preserver is constructed to be fully reversible and the attaching strap assembly of the life preservers is specifically designed to enable the strap to be secured about the wearer of the life preserver regardless of which side of the life preserver faces forwardly. In addition, the neck opening of the life preserver, at each end thereof, includes a flexible outstanding collar including a draw strap passing through a tubular collar hem to thereby enable the forwardly and upwardly facing collar of the life preserver to be tightened about the wearer.

A survival and training apparatus for children is constructed in the form of a teddy bear. The teddy bear has an exterior casing formed of multiple durable materials including a fluorescent fabric of lime yellow color that is visible during daytime conditions and a reflective fabric to facilitate visibility during nighttime conditions. A third fabric which stores light energy during the day and then emits it at night can also be included in the casing materials. The teddy bear also includes in interior filling material of polystyrene beads that facilitates human body heat insulation when the survival teddy bear is held by the child and imparts buoyancy to enable the survival teddy bear to operate as a floatation device. The survival apparatus hits a pocket formed in the back to receive and warm a child's hands. A whistle is attached via a chord to the pocket and can be alternatively inserted into the pocket for storage and retrieved therefrom for use by the child. The survival teddy bear is also equipped with a detachable blanket housed in the pocket which can be removed for additional warmth and protection from poor weather conditions. The apparatus is well suited for helping to train a child in the survival rules and techniques necessary for safe venture into wilderness areas.

A life preserver child bed flotation assembly includes a base having an annular framework encompassing an open central region defined through the base and an annular flotation collar attached to the framework for providing flotation capability to the base, a shell-shaped seat for reclining a child being supported on the base by the annular framework thereof and substantially over the open central region therethrough, and a life preserver vest for releasably securing the child within the seat. The seat has front, rear and side walls connected together at their respective opposite ends and a bottom wall connected with lower edges of the front, rear and side walls. The bottom wall has forward and rearward reversely inclined portions connected together to permit the reclining of the child within the seat. The front, rear and side walls have inner and outer portions spaced apart so as to define an internal cavity therebetween being filled with a foam-like material for providing flotation capability to the seat. An annular flange extends around and is connected to the outer portions of the front, rear and side walls and is releasably connected by detent elements to sections of the annular framework of the base. The life preserver vest has a chest portion, a crotch portion and straps attached thereto and to the walls of the seat for releasably securing the child within the seat.

A new life jacket with flexible life line for allowing a user to have a life line conveniently located on their life jacket so that the line can be easily accessed during a rescue. The inventive device includes a life jacket with a top, a bottom, and front and back floatation panels. The panels define a pair of side spaces between them which are each adapted for extending an arm therethrough. A flexible pouch having an interior compartment and a top opening into the interior compartment is coupled to the front and back floatation panels. A length of flexible line having opposite ends is disposable in the interior compartment of the pouch such that the ends of the flexible line are extended from the pouch. One of the ends of the flexible line has a fastening clip coupled thereto which is detachably attachable to a portion of the life jacket for securing the one end of the flexible line to the life jacket.

The life preserver for an infant or young child includes a pair a vertically stacked, peripherally disposed, inflatable tubes. A life vest is sized to enclose the torso of the infant or young child. The life vest is attached at a plurality of locations to the interior or inboard region of one of the vertically stacked, peripheral tubes. Preferably, the life vest is attached to the tube via short straps such that the vest can move with respect to the inflated or deflated tubes. A seat for the infant or young child is attached at a plurality of locations to the interior of one of the vertically stacked peripheral tubes. Preferably, the seat is attached at a forward and an aft region to the top tube. The life preserver also includes a drag bag attached at a plurality of locations to the interior of one of the vertically stacked, peripheral tubes. The drag bag acts as a ballast for the loaded and deployed life preserver. Preferably, the drag bag is attached via straps to the tubes such that the bag can move with respect to the tubes in an inflated or a deflated mode.

While these flotation devices may be suitable for the purposes for which they were designed, they would not be as suitable for the purposes of the present invention, as hereinafter described.

SUMMARY OF THE PRESENT INVENTION

A primary object of the present invention is to provide a flotation life vest which will accommodate various body types.

Another object of the present invention is to provide a flotation life vest having a plurality of adjustable straps for fixedly positioning the flotation life vest about the torso of the user.

Yet another object of the present invention is to provide a flotation life vest having a flotation element positioned behind the head of the user.

Still yet another object of the present invention is to provide a flotation life vest having a flotation element positioned behind the buttocks of the user.

Another object of the present invention is to provide a flotation life vest having flotation elements frontally positioned extending vertically along the torso of the user.

Yet another object of the present invention is to provide a flotation life vest having a noise generating element in the form of a whistle attached by an extendable retractable tether to the flotation life vest.

Still yet another object of the present invention is to provide a flotation life vest having a pocket for the storage of a fresh water container.

Another object of the present invention is to provide a flotation life vest having frontal flotation elements and rear flotation elements.

Yet another object of the present invention is to provide a flotation life vest having frontal flotation elements and rear flotation elements that will permit the user to assume a horizontal position in the water which will permit the user to swim or lie on their back to rest.

Still yet another object of the present invention is to provide a flotation life vest that will extend the survivability of the wearer while in the water.

Additional objects of the present invention will appear as the description proceeds.

The present invention overcomes the shortcomings of the prior art by providing a flotation life vest having a plurality of frontal straps providing the user with means for adjusting the life vest to the chest and abdominal areas of the user.

The flotation life vest has a plurality of flotation elements. One of these elements is fixedly positioned on the back of the vest behind the head of the user. Another element is positioned on the back of the vest behind the buttocks of the user. There are also two flotation elements on the front of the vest extending vertically between the upper chest area and lower abdomen of the user.

Unlike the prior art, the positioning of the floatation elements provides the user with the ability to lie in a horizontal position. The prior art is intended to keep the user in a vertical position. By having the rear flotation elements positioned outside of the frontal flotation elements, the wearer can swim until tired, then lay on his or her back to rest.

In addition to the positioning of the flotation elements, the flotation life vest has additional survival features. A whistle is attached to the vest by an extendable retractable tether. The whistle can be used for alerting nearby boats or lifeguards as to the wearer's position or a need for help.

Also provided is a pocket within the vest that contains a water bottle for the storage of fresh water.

Furthermore, a flotation vest device is provided, comprising: a vest portion, the vest portion having armholes for insertion of the user's arms, a back portion, the back portion having a top end and a bottom end, and a front portion, the front portion having a left portion and a right portion, the left and right front portions being separable to form a vest opening; a fastener for joining the vest left front portion to the right front portion; at least one front flotation pair, each pair having a left front flotation device attached to the vest left portion and a right front flotation device attached to the vest right front portion, the left front flotation device and the right front flotation device each having a top end and a bottom end; a buoyant neck stabilizer attached to the vest back top end, the buoyant neck stabilizer being sized and positioned to support the user's head and neck when the user is in a substantially horizontal position, the buoyant neck stabilizer having a top end, the top end extending beyond the left front flotation device top end and the right front flotation device top end; and a buoyant buttocks support attached to the vest back bottom end, the buoyant buttocks support being sized and positioned to support the user's buttocks when the user is in a substantially horizontal position, the buoyant buttocks support having a bottom end, the bottom end extending beyond the left front flotation device bottom end and the right front flotation device bottom end.

In another embodiment, the device further comprises a whistle and lanyard, the lanyard attaching the whistle to the vest portion.

In another embodiment, the device further comprises a retracting device for retracting and storing the whistle lanyard.

In another embodiment, the device further comprises a pocket on the vest, a whistle, a lanyard, and a lanyard retraction device for retracting and storing the whistle lanyard, the vest pocket being sized and configured to store the lanyard retraction device and allow operation of the lanyard retraction device while the lanyard retraction device is in the vest pocket.

In another embodiment, the device further comprises a pocket on the vest, and a water container, the pocket being sized to retain the water container.

In another embodiment, the vest back portion, the buoyant buttocks support and the buoyant neck stabilizer are approximately the same thickness.

In another embodiment, the vest back portion, the buoyant buttocks support and the buoyant neck stabilizer are integrated and stiff.

In another embodiment, the vest is made of a buoyant material.

In another embodiment, the number of front flotation pairs is two.

In another embodiment, the vest fasteners are adjustable such that the vest can be fitted to users of various sizes.

In another embodiment, the buoyant neck stabilizer supports the head and neck such that the head and neck are generally aligned with the user's spine.

In another embodiment, the plane of the buoyant neck stabilizer forms an obtuse angle with the plane of the vest back portion.

In another embodiment, the obtuse angle is greater than 135 degrees.

In another embodiment, the plane of the buoyant buttocks support is generally aligned with the plane of the vest back portion.

In another embodiment, the buoyant neck stabilizer has a tapered thickness, the thickness being decreased as the buoyant neck stabilizer extends away from the vest back portion.

Also, a flotation vest device is provided, comprising: a vest portion, the vest portion having armholes for insertion of the user's arms, a back portion, the back portion having a top end and a bottom end, and a front portion, the front portion having a left portion and a right portion, the left and right front portions being separable to form a vest opening; means for fastening the vest left front portion to the right front portion; first flotation means attached to the vest left and right front portions; second flotation means attached to the vest back portion top end for buoyantly supporting the user's head and neck when the user is in a substantially horizontal position; and third flotation means attached to the vest back portion bottom end for buoyantly supporting the user's buttocks when the user is in a substantially horizontal position.

In another embodiment, the device further comprises means for originating a whistle noise, the means being attached to the vest portion.

In another embodiment, the device further comprises means for originating an emergency noise, the means being attached to the vest portion.

In another embodiment, the device further comprises means for storing and accessing a water container, the means being attached to the vest portion.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings.

FIG. 1 is an illustrative view of the present invention being worn by a small user while in the water. The flotation life vest has a plurality of frontal straps for fixedly position the vest about the torso of the user. The rear flotation elements, fixedly positioned on the back of the vest behind the head of the user and behind the buttocks of the user, provide means for permitting the user to rearwardly incline while wearing the vest. The two frontal flotation elements help provide lift to the torso of the wearer. This positioning of the flotation elements provides the user with the ability to lie in a substantially horizontal position either front or rear. Also shown is a whistle attached to the front of the vest by means of an extendable retractable tether, whereby the user can blow on said whistle to alert nearby boats or lifeguards as to the wearer's position or a need for help.

Figure 2:
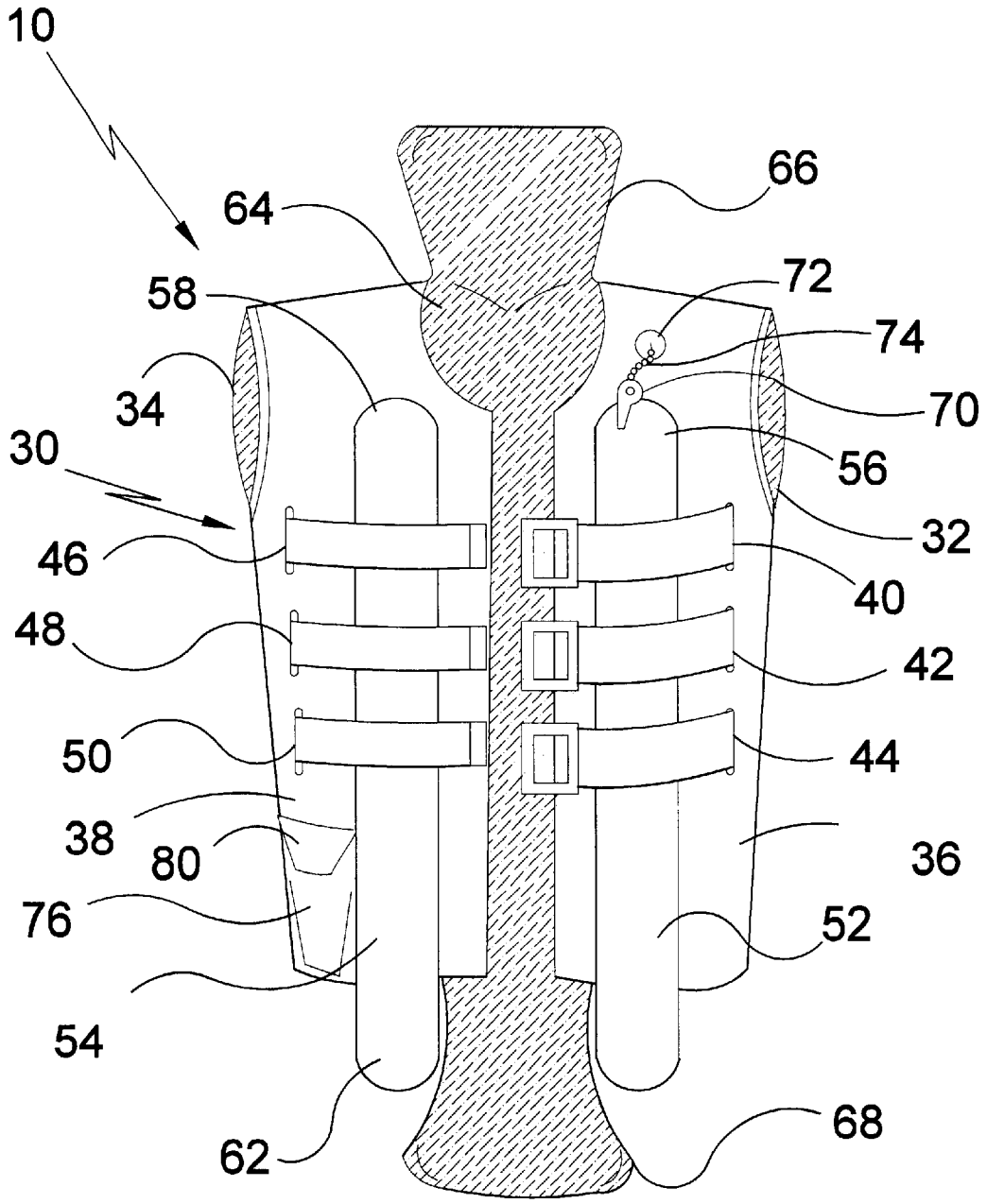

FIG. 2 is a front view of the present invention. Shown is a plurality of straps for fixedly positioning the flotation life vest about the torso of the user. Also shown are the frontal flotation elements extending vertically along the torso of the vest and two rear flotation elements located opposite and extending beyond the distal ends of the frontal flotation elements. Additionally shown is a whistle attached to said vest by means of an extendable retractable tether, and a pocket wherein can be placed a container holding fresh water.

Figure 3:
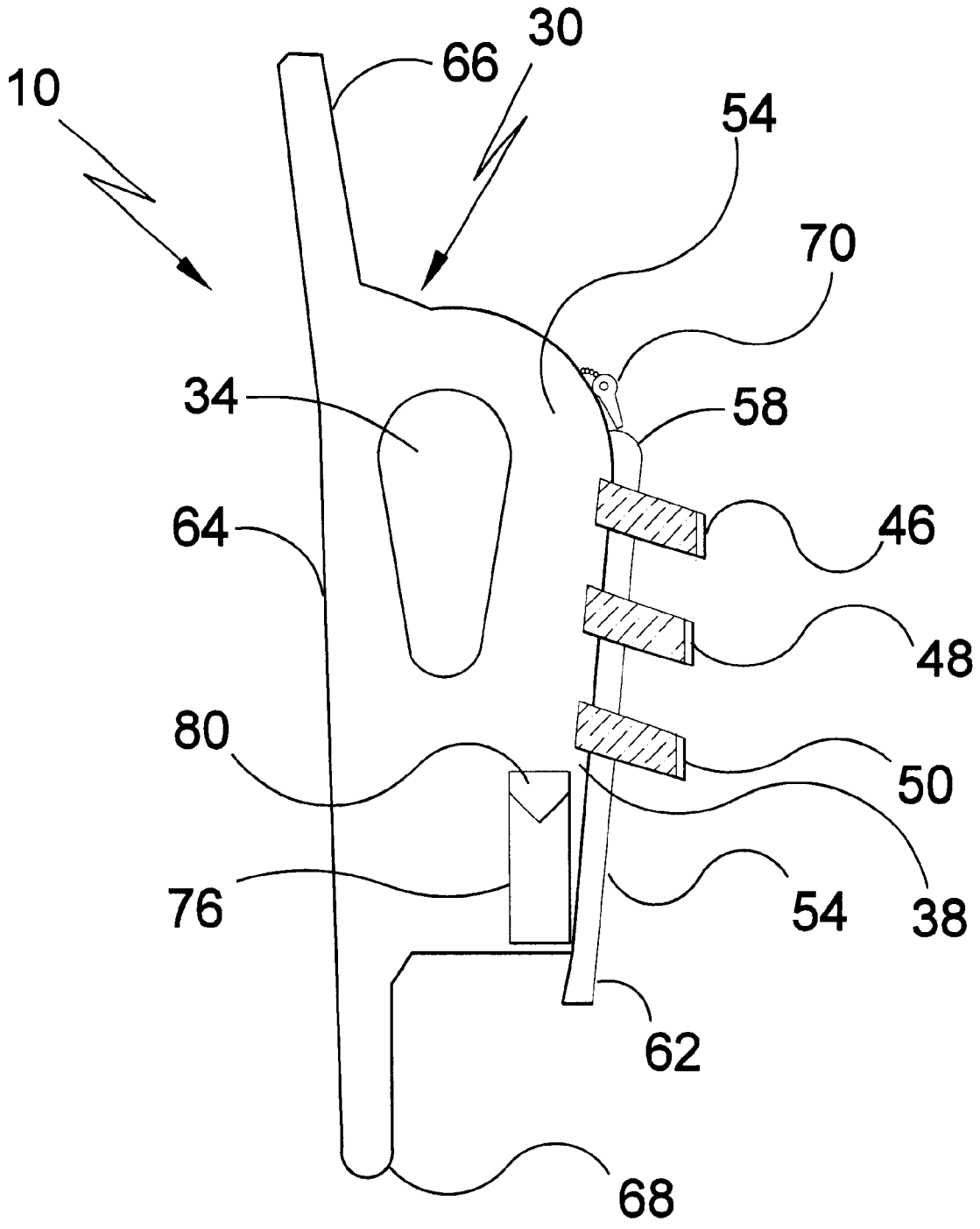

FIG. 3 is a side view of the present invention. Shown is a vest having apertures for inserting arms therethrough, and having a plurality of straps for fixedly positioning the flotation life vest about the torso. Also shown are the rear flotation elements extending substantially beyond the distal ends of the frontal flotation elements. Also shown is a pocket wherein can be placed a container holding fresh water.

Figure 4:
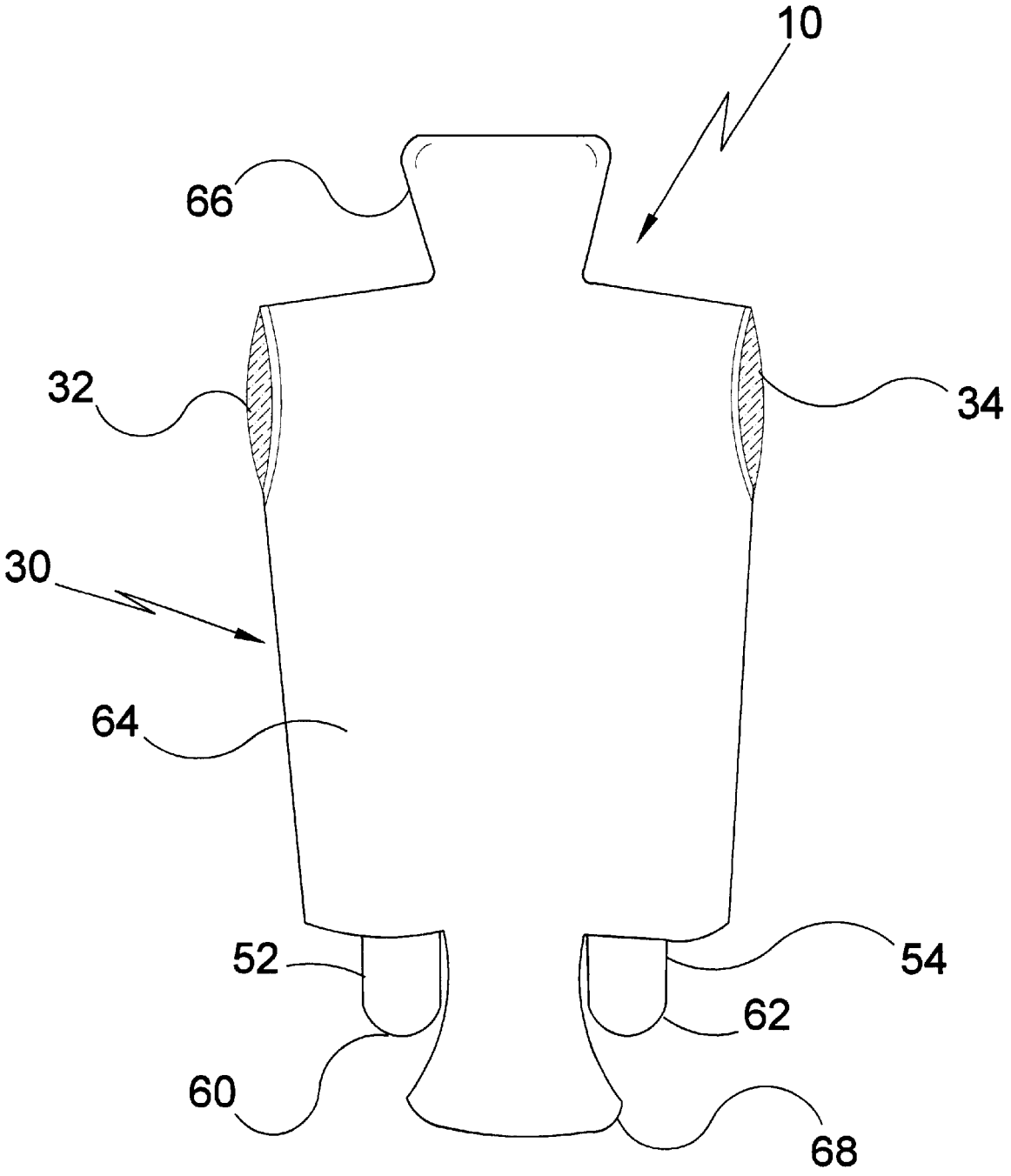

FIG. 4 is a rear view of the present invention. Shown are apertures for inserting arms therethrough. Also shown are the rear flotation elements comprising a neck and head flotation element and a lower buttocks positioned flotation element.

Figure 5:
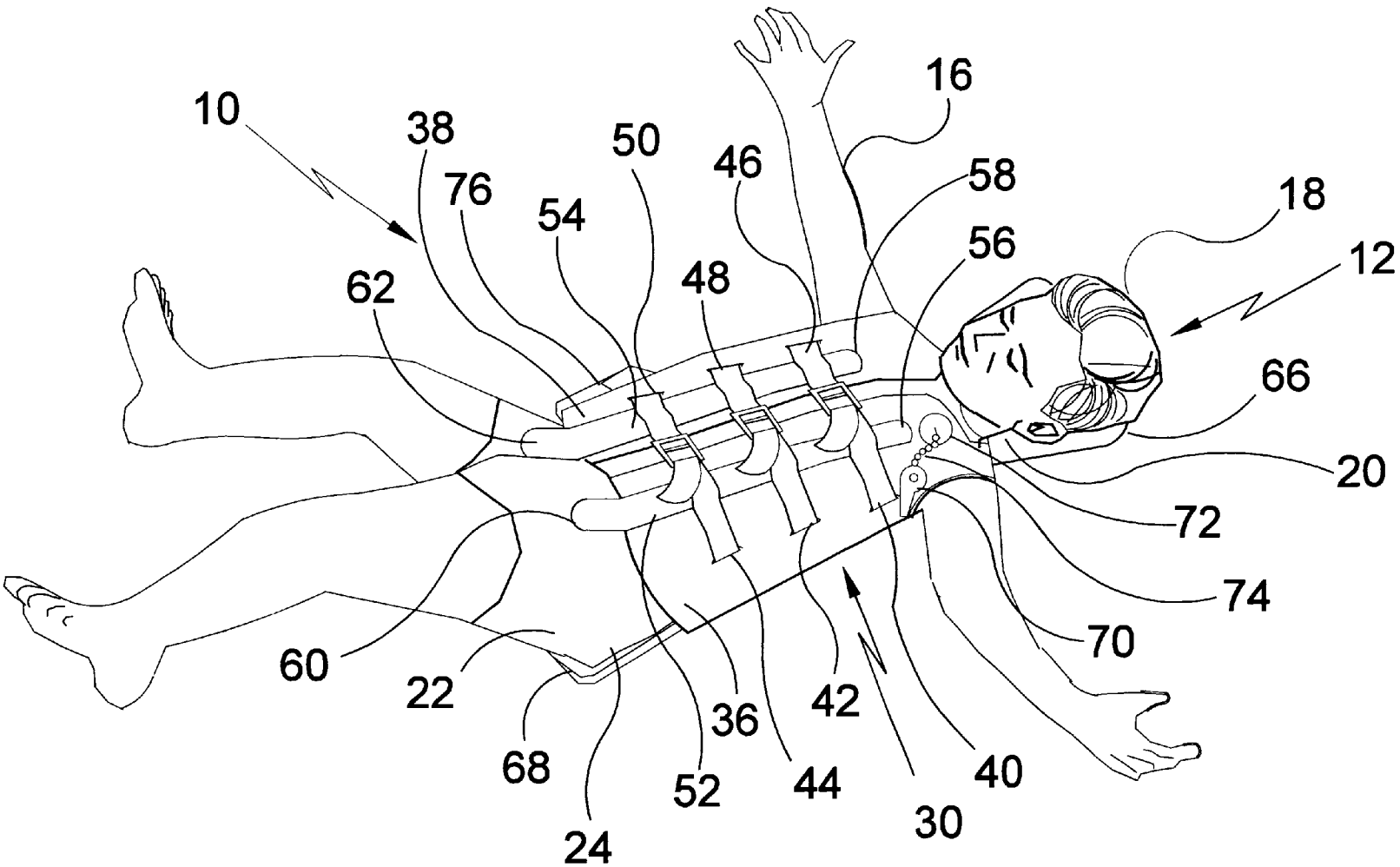

FIG. 5 is an illustrative view of the present invention being worn by a user in a back float position. The flotation life vest, having two rear flotation elements positioned outside the distal ends of the frontal flotation elements provides the user with the ability to lie in a back horizontal position supporting the head and buttocks of the user, while the frontal flotation elements keep the user from rolling face down. Also shown is a whistle fixedly attached to the vest by an extendable retractable tether that can be used to alert nearby boats or lifeguards as to the wearer's position or a need for help. Also shown is a pocket within the vest for storing a bottle of fresh water.

Figure 6:
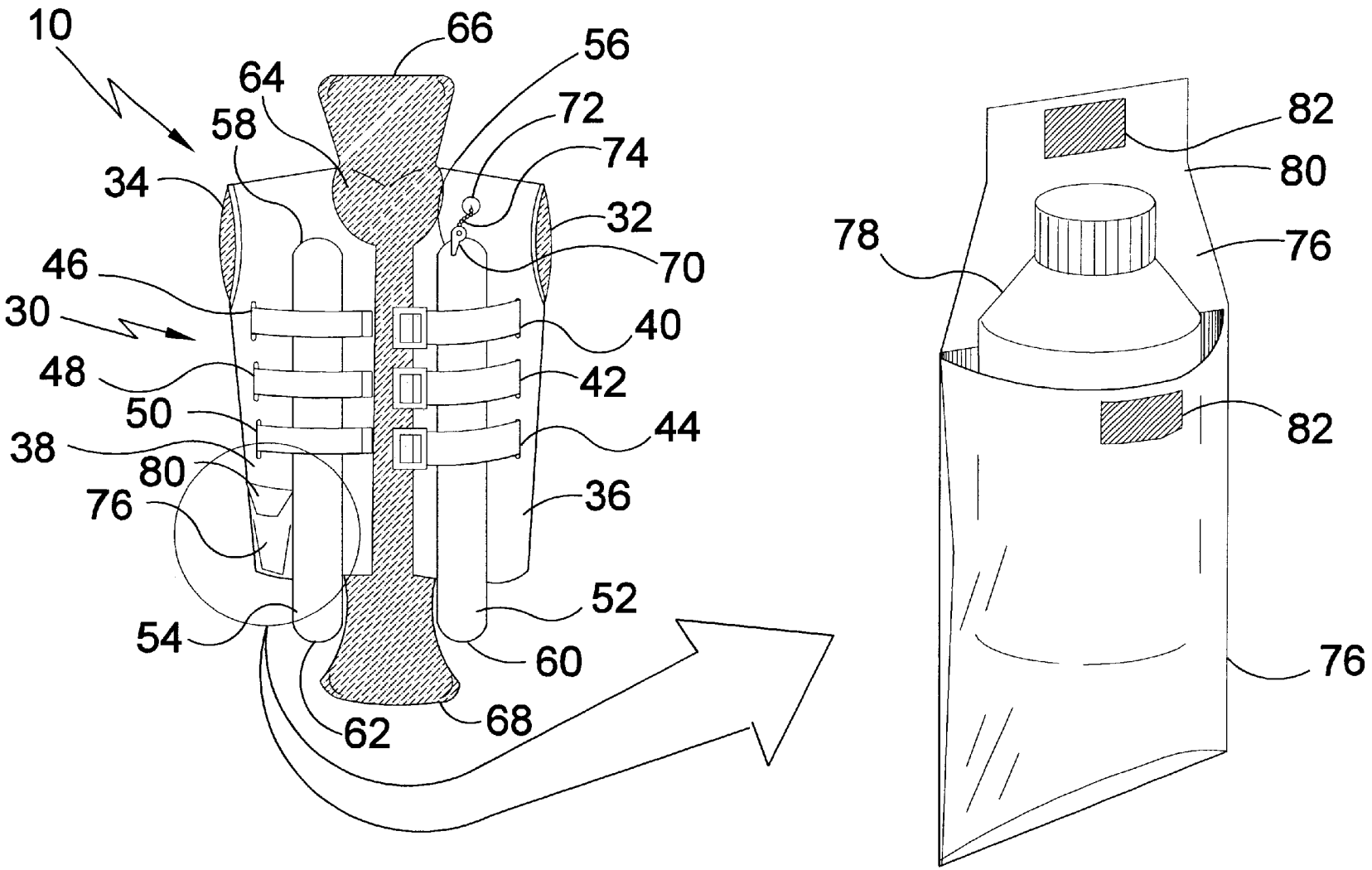

FIG. 6 is a front view of the present invention with an enlarged view of the pocket, having a water bottle positioned therein having mating hook and loop material attached to the flap and to the pocket, providing means of closure for said pocket. The front of the flotation life vest has a plurality of straps for fixedly positioning the flotation life vest about the torso of the user. The frontal flotation elements extend vertically along the torso of the vest and two rear flotation elements are located opposite and extend beyond the distal ends of the frontal flotation elements. Also shown is a whistle attached to the upper portion of the vest by means of an extendable retractable tether.

Figure 7:
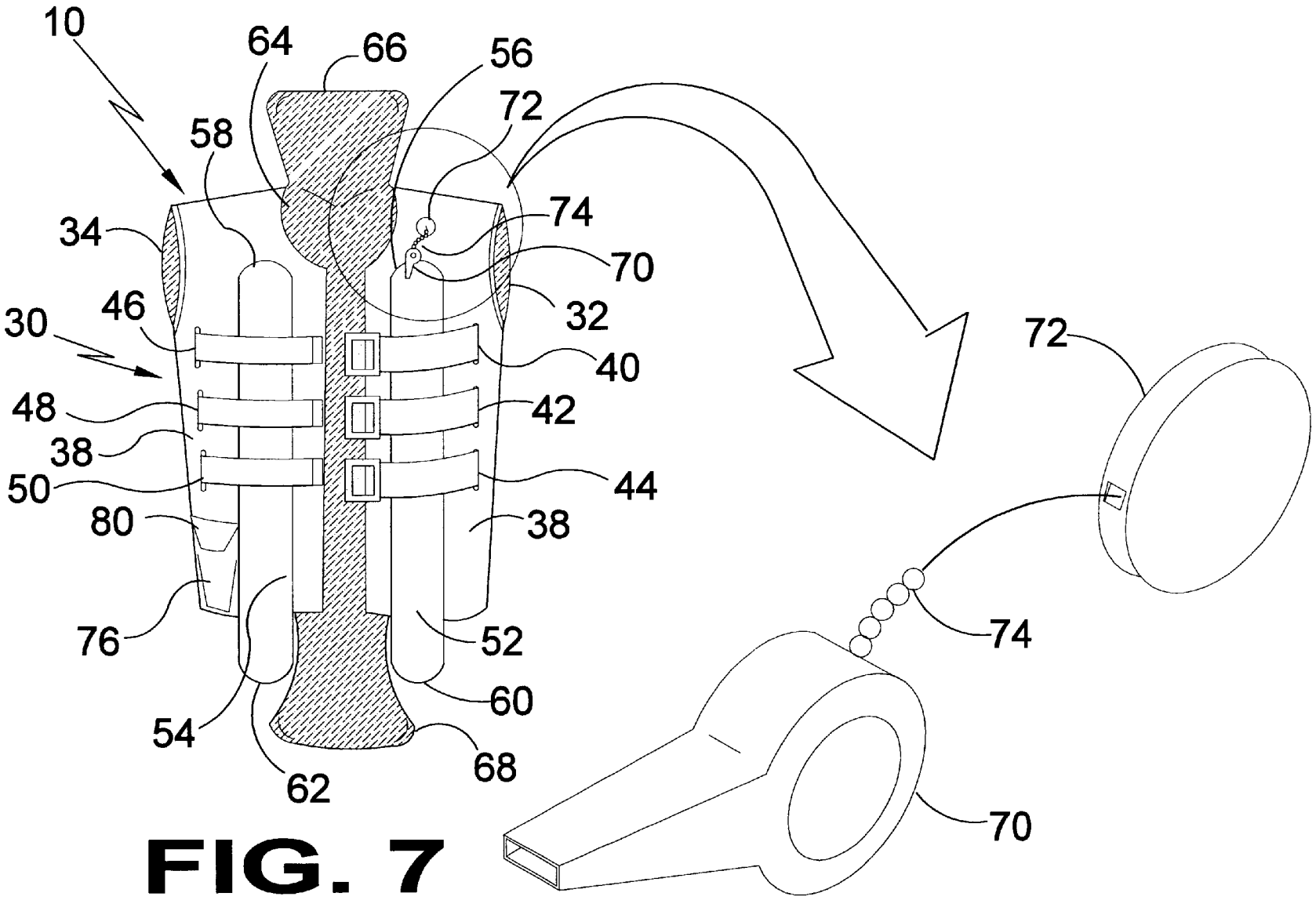

FIG. 7 is front elevation of the present invention with an enlarged view of the tethered attached whistle having an extending and retracting element for said tether. The whistle can be used for alerting nearby boats or lifeguards as to the wearer's position or a need for help. The front of the flotation life vest has a plurality of straps for fixedly positioning the flotation life vest about the torso of the user. The frontal flotation elements extend vertically along the torso of the vest and two rear flotation elements are located opposite and extend beyond the distal ends of the frontal flotation elements. Also shown is a pocket wherein can be stored a bottle of fresh water.

DESCRIPTION OF THE REFERENCED NUMERALS

Turning now descriptively to the drawings, in which similar reference characters denote similar elements throughout the several views, the figures illustrate the Toddler/Adult Float Jacket of the present invention. With regard to the reference numerals used, the following numbering is used throughout the various drawing figures.

10 Toddler/Adult Float Jacket of the present invention
12 user
14 water
16 user's arms
18 user's head
20 user's neck
22 user's buttocks
24 user's back
30 vest

32 left armhole
34 right armhole
36 vest left front portion
38 vest right front portion
40 first fastener first portion
42 second fastener first portion
44 third fastener first portion
46 first fastener second portion
48 second fastener second portion
50 third fastener second portion
52 left front flotation member
54 right front flotation member
56 left front flotation member top end
58 right front flotation member top end
60 left front flotation member bottom end
62 right front flotation member bottom end
64 vest back portion
66 neck stabilizing member
68 buttocks support member
70 whistle
72 retractor
74 lanyard
76 water container pocket
78 water container
80 water container pocket flap
82 water container pocket hook-and-loop fastener

DETAILED DESCRIPTION OF THE PREFERRED EMBODIMENTS

Turning now descriptively to the drawings, in which similar reference characters denote similar elements throughout the several views, FIGS. 1–10 illustrate the Toddler/Adult Float Jacket of the present invention, indicated generally by the numerals 10.

The Toddler/Adult Float Jacket 10 is shown generally in FIGS. 1–7 and in use by a child user 12 in the water 14 in FIGS. 1 and 5. As shown in FIGS. 2–4, the device 10 is generally configured as a vest 30 having armholes 32,34 for the user's arms 16. The vest 30 has a left front portion 36 and a right front portion 38. Three first belt fastener portions 40,42,44 are attached to the left front portions 36, and three corresponding second belt fastener portions 46,48,50 are attached to the right front portion 38. Traditional strap and buckle type fasteners are shown although other commonly utilized adjustable fasteners are also provided, e.g. hook-and-loop fasteners, zippers and button-loop fasteners.

At least one pair of front flotation members 52,54 are provided, the left flotation member 52 being attached to the vest left front portion 36, and the right flotation member 54 being attached to the vest right front portion 38. Each of the left and right front flotation members 36,38 are elongated and have a top end 56,58 and a bottom end 60,62. The bottom ends 60,62 protrude below the vest left front portion 36 and vest right front portion 38. Additional pairs of front flotation members are also provided in other embodiments.

The flotation members 52,54 size and material will dictate whether the vest front portions 36,38 will be made of buoyant material, and whether additional pairs of flotation members are required. In the preferred embodiment, the vest front portions 36,38 are constructed from a buoyant material.

The vest 30 has a back portion 64. Integrated with the vest back portion 64 is a buoyant neck stabilizing member 66 that extends upwardly, and slightly rearwardly, from the vest back portion 64, as shown in FIG. 3. In the preferred embodiment, the thickness of the neck stabilizer 66 decreases slightly as the neck stabilizer 66 extends away from the vest back portion 64. FIG. 1 shows that the chosen angle optimizes the positioning of the user's head 18 and neck 20 when the user 12 is in a substantially horizontal position, holding the head 18 and neck 20 relatively straight. An angle between the neck stabilizing member 66 and the vest back portion 64 of more than 135 degrees should be chosen. The neck stabilizing member 66 extends upwardly beyond the top ends 56,58 of the left front flotation member 52 and the right front flotation member 54.

Also integrated with the vest back portion 64 is a buoyant buttocks support member 68 that extends downwardly from the vest back portion 64. As shown in FIG. 3, the buttocks support member 68 extends downwardly in a substantially straight direction. When the user 12 is in a substantially horizontal position in the water 14, the buttocks support member 68 will support the user's buttocks 22 and prevent an uncomfortable arching of the user's back 24 about the vest back portion 64, as shown in FIG. 3. The buttocks support member 68 extends downwardly below the bottom ends 60,62 of the left and right front flotation members 52,54.

In the preferred embodiment, the vest back portion 64, the neck stabilizing member 64, and buttocks support member 68 are continuous, of approximately the same thickness, and of sufficient stiffness to act as a full-body support when in a horizontal position in the water 14. In other embodiments the vest back portion 64 is flexible and of similar construction as the vest front portions 36,38.

For circumstances where the child 12 has become tired or has drifted to an unacceptable location, the device 10 includes a whistle 70, as shown particularly FIG. 7. A retractor 72 is positioned on the vest left front portion 74 within easy reach of the child 12. The whistle 70 has a lanyard 74 that is retracted by the retractor 72 and stored therein. When needed the child 12 pulls the whistle 70 to his or her mouth and sounds the alarm. When finished the child 12 releases the whistle 70 and the extended lanyard 72 portion is retracted into the retractor 70.

For extended periods of time in the water 14, the device 10 includes a pocket 76 for storing and securing a fresh water container 78. The pocket 76 is conveniently positioned for easy access by the child 12 when resting in a substantially horizontal position, as shown in FIG. 6. The pocket 76 has a flap 80 for closing, that is fastenable using a hook-and-loop fastener 82.

The device 10 and its foregoing components can be constructed using various materials, including various fabrics and buoyant materials such as plastic foam, foamed polyethylene, closed cell plastic foam, styrofoam and foam rubber. The materials, in various component combinations, can be buoyant and non-buoyant, and can be sized to accommodate users of various sizes, all in accordance with the present invention, and as determined by the intended end use for the overall device, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A flotation vest device, comprising:

a vest portion, the vest portion having armholes for insertion of the user's arms, a non-inflatable back portion, the back portion having a top end and a bottom end, and a front portion, the front portion having a left portion and a right portion, the left and right front portions being separable to form a vest opening;

a fastener for joining the vest left front portion to the right front portion;

at least one front flotation pair, each pair having a left front flotation device attached to the vest left portion and a right front flotation device attached to the vest right front portion, the left front flotation device and the right front flotation device each having a top end and a bottom end;

a buoyant, non-inflatable neck stabilizer attached to the vest back top end, the buoyant neck stabilizer being sized and positioned to support the user's head and neck when the user is in a substantially horizontal position, the buoyant neck stabilizer having a top end, the top end extending beyond the left front flotation device top end and the right front flotation device top end;

a buoyant, non-inflatable buttocks support attached to the vest back bottom end, the buoyant buttocks support being sized and positioned to support the user's buttocks when the user is in a substantially horizontal position, the buoyant buttocks support having a bottom end, the bottom end extending beyond the left front flotation device bottom end and the right front flotation device bottom end; and the vest back portion, the buoyant neck stabilizer, and the buttocks support being continuous and integral with each other, of approximately the same thickness, and of sufficient stiffness to act as a full body support when a user is in a horizontal position when in the water.

2. The device of claim 1, further comprising a whistle and lanyard, the lanyard attaching the whistle to the vest portion.

3. The device of claim 2, further comprising a retracting device for retracting and storing the whistle lanyard.

4. The device of claim 1, further comprising a pocket on the vest, a whistle, a lanyard, and a lanyard retraction device for retracting and storing the whistle lanyard, the vest pocket being sized and configured to store the lanyard retraction device and allow operation of the lanyard retraction device while the lanyard retraction device is in the vest pocket.

5. The device of claim 1, further comprising a pocket on the vest, and a water container, the pocket being sized to retain the water container.

6. The device of claim 1, wherein the vest back portion, the buoyant buttocks support and the buoyant neck stabilizer are approximately the same thickness.

7. The device of claim 1, wherein the vest back portion, the buoyant buttocks support and the buoyant neck stabilizer are integrated and non-articulated.

8. The device of claim 1, wherein the vest is made of a buoyant material.

9. The device of claim 1, wherein the number of front flotation pairs is two.

10. The device of claim 1, wherein the vest fasteners are adjustable such that the vest can be fitted to users of various sizes.

11. The device of claim 1, wherein the buoyant neck stabilizer supports the head and neck such that the head and neck are generally aligned with the user's spine.

12. The device of claim 1, wherein the plane of the buoyant neck stabilizer forms an obtuse angle with the plane of the vest back portion.

13. The device of claim 12, wherein the obtuse angle is greater than 135 degrees.

14. The device of claim 1, wherein the plane of the buoyant buttocks support is generally aligned with the plane of the vest back portion.

15. The device of claim 1, wherein the buoyant neck stabilizer has a tapered thickness, the thickness being decreased as the buoyant neck stabilizer extends away from the vest back portion.

* * * * *